United States Patent [19]

Skaadel et al.

[11] 4,136,723

[45] Jan. 30, 1979

[54] FLEXIBLE CONTAINER FOR TRANSPORTATION AND STORAGE OF BULK MATERIAL

[75] Inventors: Johannes Skaadel, Skien; Bjarne Omdal, Porsgrunn, both of Norway

[73] Assignee: Norsk Hydro A.S., Oslo, Norway

[21] Appl. No.: 810,473

[22] Filed: Jun. 27, 1977

[30] Foreign Application Priority Data

Jun. 28, 1976 [NO] Norway ..... 762230

[51] Int. Cl.[2] ..... B65D 29/00

[52] U.S. Cl. ..... 150/1; 229/57

[58] Field of Search ..... 150/1, 12; 229/54 R, 229/57, 58

[56] References Cited

U.S. PATENT DOCUMENTS

| | | | |
|---|---|---|---|
| 2,196,185 | 4/1940 | Belcher | 229/54 R |
| 3,001,207 | 9/1961 | Nail | 150/1 X |
| 4,010,784 | 3/1977 | Nattrass | 150/1 |

FOREIGN PATENT DOCUMENTS

| | | | |
|---|---|---|---|
| 2453457 | 5/1975 | Fed. Rep. of Germany | 150/1 |
| 977067 | 12/1964 | United Kingdom | 150/12 |

*Primary Examiner*—Donald F. Norton

*Attorney, Agent, or Firm*—Wenderoth, Lind & Ponack

[57] ABSTRACT

A single piece of material is formed to have enclosing side walls, the bottom edges of which are cut to form at least four flaps which are direct extensions of the side walls. The lower edges of pairs of the flaps are joined to form joints which cross at a single point.

5 Claims, 5 Drawing Figures

FLEXIBLE CONTAINER FOR TRANSPORTATION AND STORAGE OF BULK MATERIAL

BACKGROUND OF THE INVENTION

The present invention relates to a flexible container for the transportation and storage of bulk material, especially free-flowing pulverulent or granular material. The invention also relates to a method for manufacturing such flexible container.

Today there are several known types of containers for transportation of free-flowing bulk material. Some are of the one-trip-type and others are intended to be used several times. Such containers are usually called Intermediate Bulk Containers.

Swedish patent application No. 7405935 describes a flexible container which can be lifted when filled. This container is provided with a special lifting device which comprises a rope, one end of which is secured to the container top. The other end of the rope runs through the center of the container and is secured at the container bottom, for instance to a plate below the container bottom. In this way the stress is better distributed when the container is lifted. Although this lifting device distributes the stress somewhat better than do conventional flexible containers, its construction is rather complicated, thus increasing the cost of manufacturing the container. Another drawback is that the container is made of a number of different components, and the total quantity of material per container is large.

Further, Danish Pat. No. 132,877 describes a flexible container having a squarish bottom section with a discharge opening that is covered by a loose piece of material. This piece is cut before discharging. Before refilling the container, a new cover-piece is placed in it. The container is equipped with four specially fastened lifting loops, and its upper section has a special lid with a filling opening that can be closed. This rather complicated container which consists of several components that have to be joined together, requires a complicated and thus expensive manufacturing apparatus, and accordingly the cost of the container is made expensive. Such a container is consequently intended to be used several times. The four separately fastened loops result in an uneven distribution of the vertical stresses in the container's fabric which thus must be made from strong and expensive material.

The present invention is the result of further development of the flexible container according to Norwegian patent application No. 4350/73, corresponding to British Pat. No. 1,475,019. This container is made from a single piece of material that is folded and sewn together along its sides and bottom. Approximately at the middle of the folded edge there is a slit which constitutes the filling opening of the container. The side seams terminate some distance from the folded edge thus providing two lifting loops which extend from the slit to the point of intersection between the imaginary extension lines of the side seams and the folded edge.

The container has proved to be well suited for transportation of bulk material. It is cheap and can therefore be used as a one-trip container. However, by destructive, dynamic testing it has been found that the stress distribution during lifting of the container is not optimal due to the design of the bottom of the container.

SUMMARY OF THE INVENTION

The object of the present invention is therefore to develop an improved bottom that can be adapted to the above mentioned container that has already proved to be a success.

Another object of the present invention is to design a bottom which also is suitable for flexible containers similar to those described above.

A further important object of the present invention is to provide an efficient and economical method for manufacturing flexible containers having the new bottom design.

The inventors have succeeded in designing a bottom which makes the container able to withstand substantially larger dynamic loads than the container according to Norwegian application No. 4350/73, corresponding to British Pat. No. 1,475,019.

According to the present invention a flexible container is made from a single piece of material in the form of a transversely cut hose or a piece of material folded crosswise or lengthwise, the sides so formed being joined together and closed in such a way that a container is formed. The container can be equipped with loops fastened to it and with means of closing its upper section. One essential feature of the invention is a method whereby the bottom section of the container is formed by making cuts parallel to the side edges, and possibly in such side edges, at the lower part of the piece of material such that at least four equally large flaps, arranged in pairs, are formed, and whereby such flaps are joined together in pairs at their lower edges in such a way that the seams thereby formed cross each other at one point. Thus the joined flaps constitute the bottom of the container.

The flexible container according to the invention is preferably made from a single piece of material, for instance of woven polypropylene. The material is folded crosswise, and joined together at the sides from just below the folded edge in which a cut is made approximately at the center thereof to form the filling opening and the lifting loops. The special feature of this method is that at the lower edge and at the center of the piece of material a cut is made, the length of which is less than or equal to one quarter of the width of the material. Furthermore, the side seams are terminated at a distance equal to the length of this cut from the lower edge of the piece of material. The four flaps thus formed are joined together in pairs such that the joints so formed are perpendicular to one another.

The characteristic feature of the flexible container according to the invention is that its bottom consists of at least four flaps which are direct extensions of the container's side walls and which are joined together in pairs at their lower edges such that the joints cross each other at one point.

The preferred design of the container is obtained when it is made from a single piece of material folded crosswise, the folded edge constituting the upper part of the loop, the special feature being that the bottom consists of four equally large flaps that are direct extensions of the container's side walls and are joined together in pairs at their lower edges such that the joints become perpendicular to each other.

The flexible container according to the invention has a bottom with a squarish form when the container is filled. The bottom is not completely closed as the flaps are joined together only at their lower edges, while the lateral edges of the flaps are free. This results in a particularly good stress distribution because the overlapping flaps constituting the bottom can shift somewhat relative to each other, thereby giving a stronger bottom than a container consisting of one integral piece of material. Because the new bottom is in fact a double one, the load on the bottom seams is halved.

A flexible container having a bottom made from for instance, six or eight flaps, will also have joints crossing each other at one point, the crossing angles being 60° and 45° respectively.

For some applications of the flexible container, it might be advantageous to sew the flaps together also at their side edges with elastic or weak thread, thereby allowing the joined flaps to shift relative to each other. By doing this, a completely closed bottom is obtained and the inner bag can be omitted.

The container is applicable for bulk material in quantities from 100 kgs up to several tons. The container can be made from fabrics, for instance woven polypropylene, from plastic material or from paper. The construction of the container according to the invention is independent of the container material, as long as the material is suitable for the intended container. The container is preferably fitted with an inner bag of an impervious material, for instance plastic or paper. The container comprises a bottom section, a central section forming side walls and an upper section having loops strong enough to allow the filled container to be lifted. The loops are preferably integral parts of the container itself, but can also be separate loops fastened to the container.

The container can be made from a single piece of material which is folded crosswise or folded lengthwise and joined together to form a bag. The container can also be made from one piece of material in the form of a transversely cut hose manufactured by extrusion or circular weaving. The bag is formed by closing one of the openings to form a bottom. The other opening constituting the top of the bag may be closed by a string or similar device, and this section can be equipped with loops for lifting.

BRIEF DESCRIPTION OF THE DRAWINGS

The design of the flexible container and the method for producing it according to the present invention will be further explained below with reference to the accompanying drawings, wherein.

DETAILED DESCRIPTION OF THE INVENTION

Figure 1:
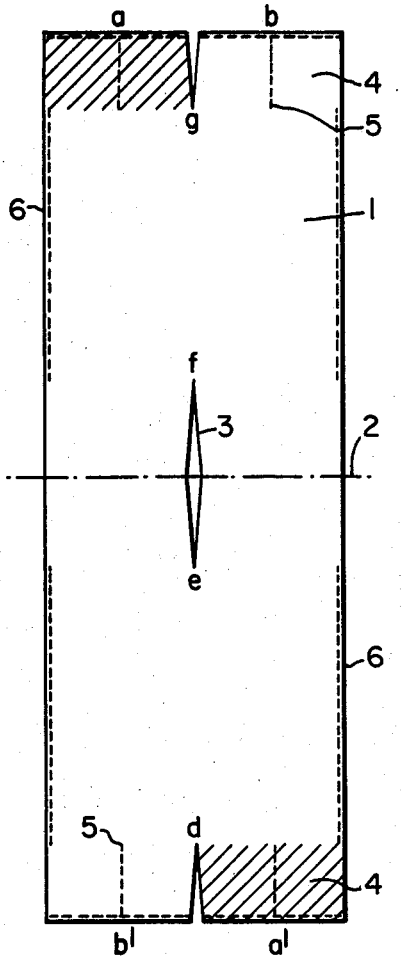
FIG. 1 is a view illustrating a single piece of material from which a flexible container according to the invention can be made.

In FIG. 1 there is shown an unfolded piece of material 1 from which a container is made according to a preferred method of the invention. This piece 1 is folded along the folding line 2. The cuts for forming filling opening 3 and for forming the flaps 4 having lower edges a, a', b and b' are made at the upper edge (i.e. the folding line) and at the lower edges, respectively, of the piece 1, and preferably after the piece 1 has been folded. To illustrate the flaps 4 more clearly, two of them are shaded. If the container is to be made with, for instance, eight flaps instead of four, cuts would also have to be made along the broken lines 5 at the lower edges of piece 1. The adjacent portions of two side edges 6 are joined together along the illustrated dotted lines, whereupon the bottom flaps are joined together in pairs such that each flap is joined to the diametrically opposite flap. Specifically, in the illustrated case of four flaps, the edges are joined together a to a' and b to b'.

Alternatively the container can be made from two pieces of material each having a width equal to half of piece 1 shown in FIG. 1. Such two pieces are joined together along the edges d-e and f-g shown in FIG. 1, before folding along the folding line 2. Cutting to form the filling opening 3 and the bottom flaps 4 will therefore be unnecessary, and the container will have four vertical side seams.

The container can also be made from one piece of material having half the width and double the length of that shown in FIG. 1. In this case also, four side seams must be made, but only one bottom seam because the inner bottom is formed by the middle of the piece of material connecting two opposite sides of the bag. The outer bottom is then formed by sewing together the two ends of the piece of material at the bottom of the other opposite sides.

Figure 2:
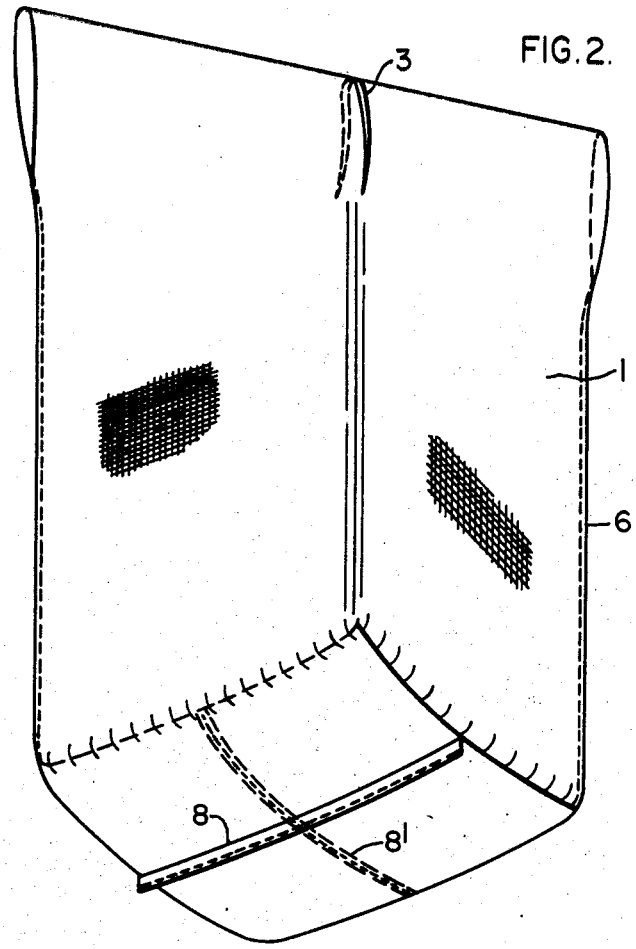
FIG. 2 is a perspective view showing a completed container made from the piece of material shown in FIG. 1.

FIG. 2 is a perspective view of the preferred container as viewed from below, such that the joints 8 and 8' of the flaps, formed by joining edges a to a' and b to b' as discussed above, are visible.

Figure 3:
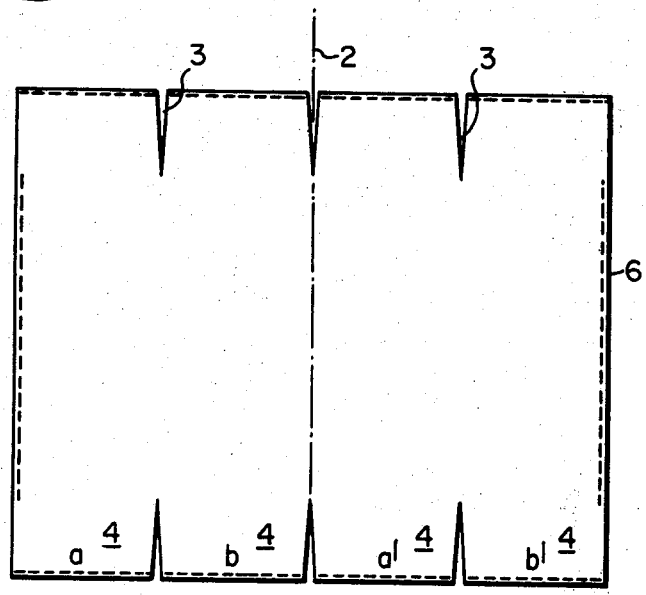
FIG. 3 is a view illustrating a piece of material that is first to be folded lengthwise when making a flexible container according to the invention.

FIG. 3 shows a design in which the folding line 2 constitutes one of the vertical edges of the container. In this embodiment the upper edge of the container must be joined together, whereby its load carrying capacity is reduced depending on the relationship between the tenacity of the warp of the material and that of the joints, as compared with the preferred design shown in FIG. 1.

Figure 4:
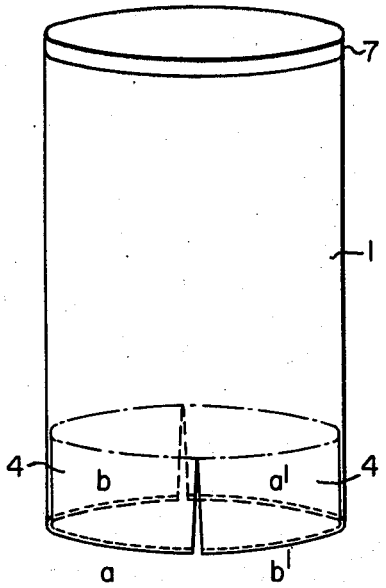
FIG. 4 is a perspective view of a circular woven piece of material in the form of a transversely cut hose having an upper opening which forms the filling opening of the container.

In FIG. 4 there is shown a design with a conventional open top made from a piece of material in the form of a circular woven, transversely cut hose. However, flat fabric having one or more vertical side seams can also be used. The container shown can be closed by lashing or by bunching and can be lifted by a clamping hook, a strap with a noose or similar device. The bead 7, made by folding and sewing the upper edge, prevents the grip from slipping out. Separate loops can also be fastened to the container's top section. This design also includes pairs of flaps 4 are joined together at their lower edges such that a is joined to a' and b to b'.

Figure 5:
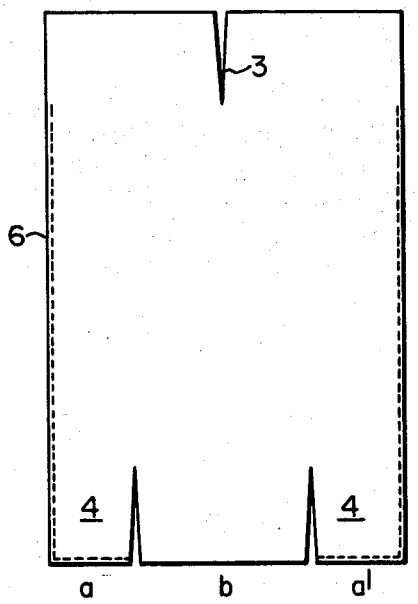
FIG. 5 is a view illustrating another transversely cut hose having openings which are joined together to constitute the side seams of the container.

FIG. 5 shows a design made from a circular woven piece of material in the form of a transversely cut hose. Such a piece of material should have a width equal to the container's total height when flattened. Cuts for the filling opening 3 are made at the center of its upper edge, and the cuts for the flaps 4 are made at the lower edge, so that $a = a' = b/2$, as shown in the drawing. The hose is cut along the edges a and a', the side edges 6 are joined together as indicated by the dotted lines and finally the flaps 4 so formed are joined together at the lower edges a and a' after the flaps are folded. Two flaps are formed by the material extending upwardly from the folded edge b, the lower edges of these flaps being already joined.

Experimental Results

Flexible containers according to Norwegian patent application No. 4350/73, corresponding to British Pat. No. 1,475,019, and the present invention were tested dynamically. Each container was hoisted up in a stand by means of a hook attached to a chain. A strain gauge for measuring the load on the container was coupled between the chain and the stand. During the tests the containers were filled with 800 kgs of free-flowing bulk material and they were allowed to fall a distance, in the following table called the maximum drop height, corresponding to the height to which the lower end of the chain was hitched up before being suddenly released. By the end of the free fall the container was stopped abruptly by the chain. The course of the load was measured by the gauge and registered on a recorder. The containers were tested as the drop height was increased between each test until failure of the container occurred.

The maximum drop height and maximum load given in the table show the drop height and corresponding recorded load to which the container was exposed before failing. Apart from a few cases where the seams had failures, the containers ruptured somewhat below the top of the loops. This means that the loops and the bottom as such can take up higher loads than the container fabric itself. The flexible containers were manufactured by two companies named I and II in the table. This explains to some extent the scatter in the test results.

Table:

| Container design | Manfact. | Test No. | Max. drop height mm | Max. load kgs |
|---|---|---|---|---|
| Acc. to Norw. appl. no. 4350/73 | I | 1 | 160 | 3040 |
| | | 2 | 220 | 4000 |
| | | 3 | 220 | 4240 |
| | | 4 | 280 | 4720 |
| | | 5 | 205 | 3360 |
| | | 6 | 250 | 3840 |
| | II | 7 | 295 | 4080 |
| | | 8 | 250 | 3240 |
| Average values | | | 235 | 3815 |
| According to the invention | I | 9 | 325 | 5360 |
| | | 10 | 415 | 6240 |
| | | 11 | 295 | 5480 |
| | | 12 | 385 | 4640 |
| | | 13 | 475 | 5400 |
| | II | 14 | 415 | 5360 |
| | | 15 | 475 | 5680 |
| Average values | | | 397.8 | 5451 |

It is evident from the above experiments that the new bottom design according to the present invention makes it possible to expose a filled container to greater loads than the previously known design according to the above mentioned Norwegian patent application. Calculated on the basis of drop height and recorded maximum load, the new container can absorb 69% more impact energy and withstand 43% higher dynamic loads.

The flexible container according to the invention therefore is not only stronger than conventional previously known containers, but can also be made by a simple method, and additionally the new bottom design does not require higher consumption of material than the container according to Norwegian application No. 4350/73 corresponding to British Pat. No. 1,475,019.

It will be apparent that various modifications of the above described specific structural arrangements and operations may be made without departing from the scope of the present invention.

We claim:

1. A flexible container for transportation and storage of bulk material, said container comprising:

a single piece of material having an upper section, side walls and a bottom section;

said upper section having lifting loops and a central filling opening;

said bottom section comprising at least four separate flaps which each have free lateral edges and which are direct extensions of said side walls; and said flaps having lower edges which are joined together in pairs to form joints that cross at a single point.

2. A flexible container as claimed in claim 1, wherein said single piece of material is transversely folded and the resultant folded edge comprises the upper part of said lifting loops, and wherein said bottom section comprises four equally sized flaps which are direct extensions of said container side walls and which have lower edges which are joined together in pairs such that said joints cross each other perpendicularly.

3. A flexible container as claimed in claim 1, wherein said single piece of material is longitudinally folded, the resultant folded edge comprises one vertical corner edge of said container, the free ends of said single piece of material opposite said folded edge are joined together to form another vertical corner edge of said container, said upper section is formed by joining portions of the upper adjacent edges of said single piece of material between said vertical corner edges, and said bottom section comprises four equally sized flaps formed from direct extensions of the container side walls, said flaps having lower edges which are joined together in pairs such that said joints cross each other perpendicularly.

4. A flexible container as claimed in claim 1, wherein said single piece of material comprises a tubular member having a transverse open bottom, said tubular member having plural slits formed vertically therein from the bottom edge thereof to thereby form said flaps.

5. A flexible container as claimed in claim 1, wherein said single piece of material comprises a tubular member having a horizontal axis and open opposite ends which are joined to form vertical seams of said side walls, said tubular member having an upper edge extending between said seams and a lower edge extending between said seams, said upper edge comprising said upper section and having therein a slit comprising said filling opening, and said lower edge having formed therein two vertical slits, each said vertical slit being spaced from a respective said seam by a distance equal to one-fourth the spacing between said seams, said lower edge being separated from each said vertical slit to the respective said seam, thereby forming one pair of flaps the lower edges of which are joined to form a joint.

* * * * *